US005188223A

United States Patent [19]

Brose et al.

[11] Patent Number: 5,188,223

[45] Date of Patent: Feb. 23, 1993

[54] FOLDING BOX

[75] Inventors: Werner Brose, Halle; Martin Augustin, Bielefeld, both of Fed. Rep. of Germany

[73] Assignee: Storck Einkauf + Service GmbH, Halle, Fed. Rep. of Germany

[21] Appl. No.: 850,403

[22] Filed: Mar. 11, 1992

[30] Foreign Application Priority Data

Mar. 14, 1991 [DE] Fed. Rep. of Germany ..... 9103091

[51] Int. Cl.[5] ..... B65D 5/50

[52] U.S. Cl. ..... 206/45.150; 206/45.18; 206/45.26; 206/45.24

[58] Field of Search ..... 206/45.15, 45.17, 45.2, 206/45.21, 45.23, 45.24, 45.26, 45.25, 45.31, 45.18; 40/124.4

[56] References Cited

U.S. PATENT DOCUMENTS

| | | | |
|---|---|---|---|
| 677,108 | 6/1901 | Weis | 206/45.2 |
| 949,904 | 2/1910 | King | 206/45.2 |
| 1,130,811 | 3/1915 | Goldsmith | 206/45.2 |
| 1,503,161 | 7/1924 | Hornecker | 206/45.21 |
| 2,314,304 | 3/1943 | Brennell | 206/45.26 |
| 2,695,097 | 11/1954 | Easton | 206/45.21 |
| 3,219,181 | 11/1965 | Dahm | 206/45.21 |
| 3,278,012 | 10/1966 | Young | 206/45.2 |
| 4,077,512 | 3/1978 | Heaton | 206/45.2 |
| 4,149,630 | 4/1979 | Transport | 206/45.24 |
| 4,311,233 | 1/1982 | Austin | 206/45.21 |

*Primary Examiner*—David T. Fidei
*Attorney, Agent, or Firm*—Henry M. Feiereisen

[57] ABSTRACT

A folding box of the type having a front side provided with a removable window cover, and a backside provided with a central bending folding, includes a flap hingedly connected with the backside and bendable along a folding line which parallels the bending fold. The flap has opposing sides which extend transversely to the bending fold, with at least one side being provided with a locking member which cooperates with a complementary locking member of the backside.

6 Claims, 2 Drawing Sheets

FOLDING BOX

BACKGROUND OF THE INVENTION

The present invention is concerned with a folding box, and in particular with a folding box of the type having a front side provided with a removable window cover and a backside which includes a central bending fold extending across the backside.

Such folding boxes are widely used as packaging containers for chocolate bars which are individually wrapped and can be separately withdrawn from the opened folding box after tearing off the window cover to create access to the chocolate bars. By bending along the bending fold, the folding box can be set up in form of a roof-shaped display box, with each side of the folding box containing one layer of chocolate bars. Since the window cover extends over both outer sides, the chocolate bars can easily be withdrawn.

Apart from the decorative effect of such folding boxes, the ease by which the chocolate bars can be withdrawn is also of advantage. Problems were encountered, however, in connection with retaining the set up display position of the folding box in which both legs of the folding box extend at an acute angle to each other and respectively accommodate a layer of chocolate bars. The folding box should stand firm also during removal of single chocolate bars, with their legs being secured in their position relative to each other. It was thus proposed to secure the folding box by means of a locking element in form of a metal foil which is glued in the area of the bending fold by partly covering the latter. Preferably, the metal foil is a compound foil with an aluminum core which greatly resists a return of the legs to their original position.

Even though the use of such a metal foil may be sufficient to secure the roof-like or acute position of the folding box, there are drawbacks which render its use uneconomic. The metal foil, which is taken from a spool, is applied, partly manually, in a separate working step upon the blank before insertion of the chocolate bars and folding of the blank to create the folding box. Since folding boxes are mass products, the necessity of additional steps and manual handling adversely affects, however, the economic efficiency of the product. Moreover, since such metal foils cannot easily be removed, the disposal of such folding boxes becomes more complicated because they cannot simply be recycled as waste paper.

SUMMARY OF THE INVENTION

It is thus an object of the present invention to provide an improved folding box obviating the afore-stated drawbacks.

This object and others, which will become apparent hereinafter, are attained in accordance with the present invention by hingedly connecting a flap to the backside of the folding box in the area of the bending fold, with the flap being foldable parallel to the bending fold and having first opposing sides extending transversely to the bending fold, with at least one side being provided with a locking member which cooperates with a complementary locking member of the backside for retaining the folding box in position when being folded along the bending fold.

Through the provision of such a folding box, the locking element, i.e. the flap, can be made as an integral part of the folding box and thus is not required to be made and applied separately. When punching out the blank for the folding box, the flap can be made in one working step with the backside.

According to another feature of the present invention, the flap has second opposing sides paralleling said bending fold and connected with the backside via respective fold lines, with the first opposing sides being defined as cutting lines so as to allow a folding of the flap independent of the bending of the backside.

Suitably, each of said cut lines is provided in the area of the bending fold with a Z-shaped section which has one tip extending into the flap, and another tip extending into the adjoining area of the backside so as to provide locking lugs which mutually interlock and support each other during folding of the flap and backside. In particular, the locking lug of the flap bears upon the adjoining area of the backside while the locking lug of the backside is supported by the adjoining area of the flap. In this manner, the bent folding box is securely locked in position.

A folding box in accordance with the present invention can be made in its entirety out of one material i.e. cardboard in a considerably easier and more cost efficient manner than previously known. In addition, the disposal of such folding boxes does not pose any problems.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
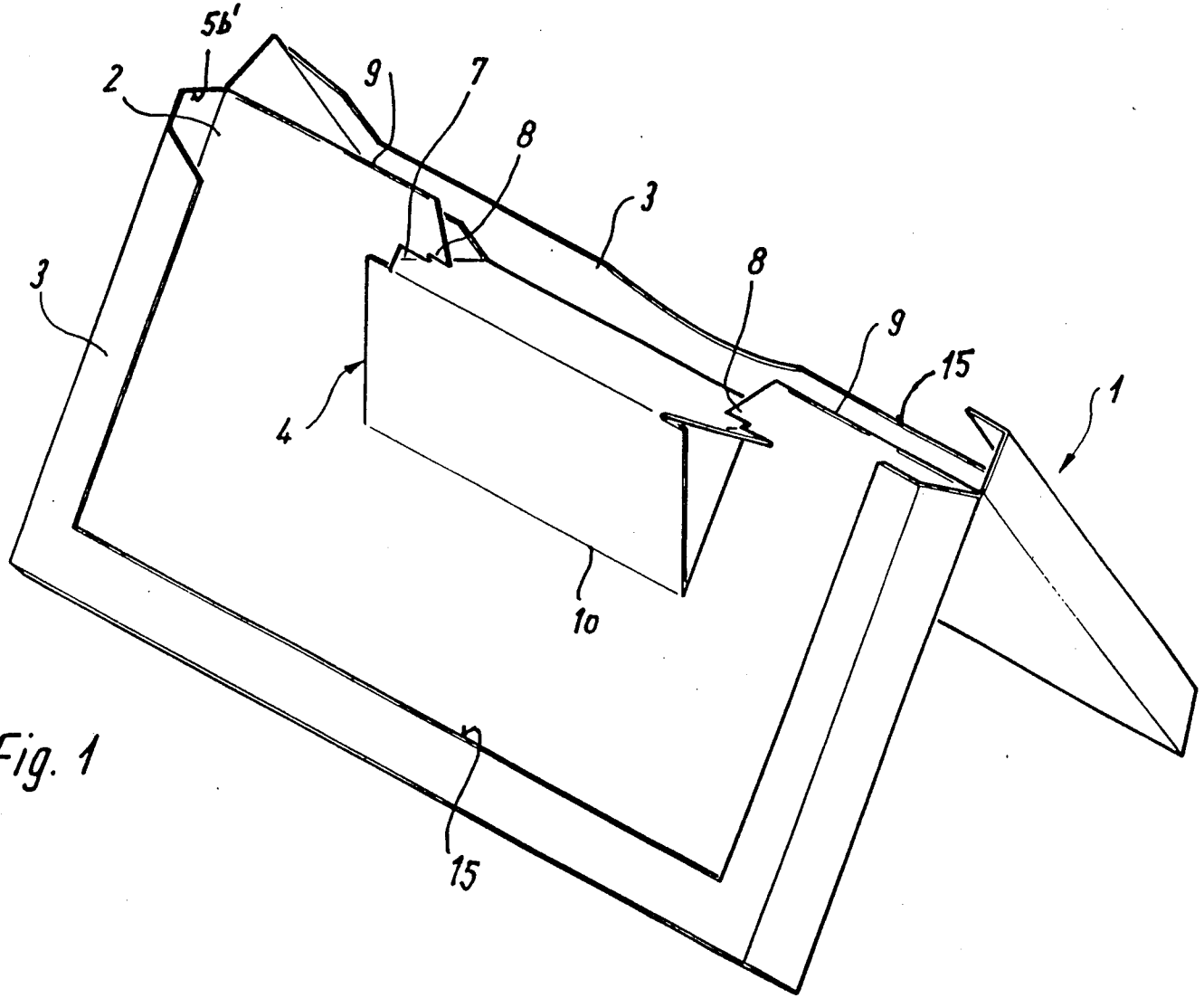
FIG. 1 is a perspective illustration of a folding box according to the present invention, with the folding box being positioned for displaying an article and allowing withdrawal thereof.

Throughout all the Figures, the same or corresponding elements are always indicated by the same reference numerals.

Referring now to FIG. 1, there is shown a perspective illustration of a folding box according to the present invention, generally designated by reference numeral 1. The folding box 1 is preferably made of cardboard and includes a backside 2 and a front side 3. As shown in particular in FIG. 3, which is a plan view of a blank for the folding box 1, the front side 3 is provided with a window cover 5 which can be torn off along a perforation 14 to open a window 15 so that the front side 3 is reduced essentially to an outer rim to form a pocket for retaining articles such as chocolate bars 12. By means of the window 15, access is provided to the interior of the folding box 1 and to the chocolate bars 12.

The window cover 5 is essentially of rectangular shape with a tab 5*a* for facilitating tearing off of the window cover 5. At one side thereof, the window cover 5 extends to the periphery to provide a semicircular section 5*b*.

Figure 2:
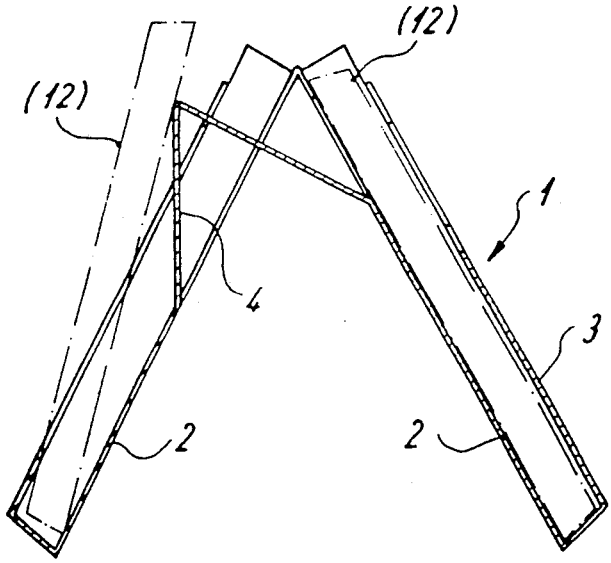
FIG. 2 is a cross sectional view of the folding box of FIG. 1, with exemplary chocolate bars contained therein.

In the position shown in FIGS. 1 and 2, the folding box 1 is set up in roof-shaped manner by bending it along a bending fold 9 which extends across the backside 2. Likewise, the front side 3 is provided with a bending fold 9*a* which coincides with the fold 9 of the backside 2 when turning or folding the front side 3 over the backside 2, as will be described furtherbelow.

Figure 3:
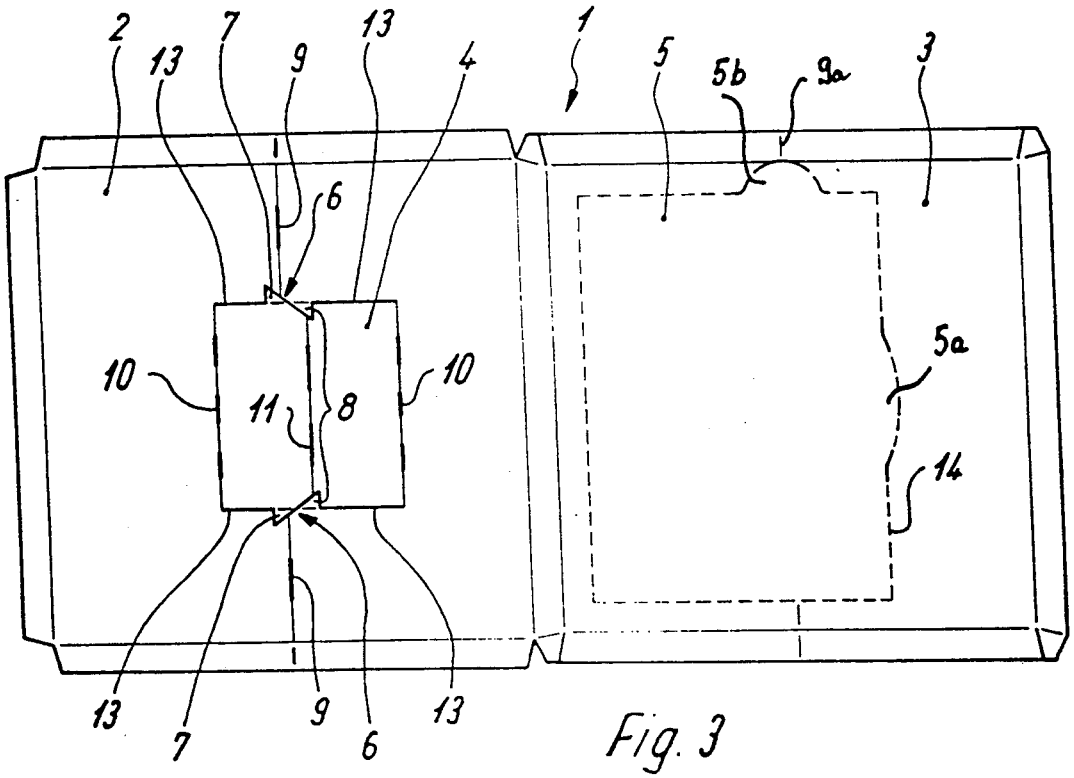
FIG. 3 is a plan view of a blank for the folding box.

The backside 2 includes a locking element in form of a generally rectangular flap 4 for retaining the folding box 1 in the set up position of FIG. 1. The flap 4 includes a central groove or depression 11 which serves as a folding line and by which the flap 4 is essentially divided in two equal halves. The groove 11 extends parallel to the fold 9, with the flap 4 being hinged at each side to the backside 2 via fold lines 10 which extend parallel to the fold 9. As shown in FIG. 3, the distance of the front-side-proximate fold line 10 from the fold 9 is greater than the distance of the front-side-distant fold line 10 from the fold 9. In a direction transversely to the fold 9, the flap 4 is bound by opposing cut lines 13 by which the connection to the backside 2 is interrupted.

In the area of the fold 9 and the groove 11, each cut line 13 is of Z-shaped configuration to create a section 6, with one tip extending into the backside 2, and with the other tip extending into the flap 4. In this manner, the flap 4 is integrally provided with a locking lug 7 and the backside 2 is integrally provided with a locking lug 8.

As shown in FIGS. 1 and 2 in which the folding box 1 is in an open position to allow removal of chocolate bars 12, the locking lugs 7 of the flap 4 are supported by the backside 2 while the locking lugs 8 of the backside 2 bear against the outwardly folded flap 4. In this manner, the locking lugs 7 and 8 at each side of the flap 4 interlock each other to thereby secure the roof-shaped configuration of the folding box 1 and to attain a secure placement of the folding box 1 to withstand usual strains.

The blank as shown in FIG. 3 can easily be made in one working cycle with the perforation 14, folds 9, 9*a*, flap 4 including fold lines 10, cut lines 13 and groove 11. In order to make the folding box 1, the front side 3 of the blank is folded over the backside 2, with the chocolate bars 12 being sandwiched therebetween and placed at both sides of the bending fold 9, and the created folding box 1 is suitably connected along the edges. When setting up the folding box 1 in a position as shown in FIGS. 1 and 2, the window cover 5 is torn off by lifting tab 5*a* and pulling along the perforation 14 to open the window 15 and to provide access to the interior. The folding box 1 is then bent along the fold 9 and 9*a*, with the flap 4 automatically swinging out and folding along the groove 11 to lock the folding box 4 in position and to force the chocolate bars 12 slightly out of the pocket into a slanted position as shown in FIG. 2. Upon tearing off the window cover 5, the semicircular section 5*b* will provide a cutout 5*b'* at one side of the folding box 1 in the area of the fold 9 to facilitate grasping and removal of chocolate bars 12.

Since the distance of the front-side-proximate fold line 10 from the bending fold 9 is greater than the distance of the other fold line 10 from the bending fold 9, and since the parallel groove 11 extends substantially central, the flap 4 can fold out from one side. In this position of the folding box 1 and the flap 4, as shown in FIGS. 1 and 2, the chocolate bars 12 bear upon the flap 4 along the groove 11 and are positioned at a distance to the backside 2 and from the chocolate bars 12 contained in the other pocket of the folding box 1. The chocolate bars 12 bearing upon the flap 4 can now be easily grasped and withdrawn.

While the invention has been illustrated and described as embodied in a folding box, it is not intended to be limited to the details shown since various modifications and structural changes may be made without departing in any way from the spirit of the present invention.

What is claimed as new and desired to be protected by Letters Patent is set forth in the appended claims:

We claim:

1. A folding box; comprising:

a front side provided with a removable window cover;

a backside provided with a central bending fold extending across said backside; and flap means provided in said backside in the area of said bending fold for locking the folding box in position and for outwardly tilting an article contained in the folding box to facilitate grasping thereof, said flap means including a flap hingedly connected with said backside and bendable along a groove which is spaced from said bending fold so as to automatically swing out toward said frontside when bending said front side and said backside along said bending fold.

2. A folding box as defined in claim 1 wherein said flap has first opposing sides extending transversely to said bonding fold, with at least one of said first opposing sides being provided with a locking member which cooperates with a complementary locking member of said backside.

3. A folding box as defined in claim 1 wherein said flap is of substantially rectangular configuration.

4. A folding box as defined in claim 2 wherein said flap has second apposing sides parallel to said bending fold and being connected with said backside along respective fold lines, said first opposing sides comprising out lines, with said groove arranged essentially central across said flap and extending parallel to said fold lines of said flap.

5. A folding box as defined in claim 4 wherein each of said cut lines is provided in the area of said bending fold and said groove with a Z-shaped section which has one tip extending into said flap and another tip extending into an adjoining area of said backside.

6. A folding box as defined in claim 4 wherein one of said fold lines of said flap extends proximate to said front side and is spaced from said bending fold by a distance which is greater than the distance of said other fold line from said bending fold.

* * * * *